US007055805B1

(12) United States Patent
Leitch

(10) Patent No.: US 7,055,805 B1
(45) Date of Patent: Jun. 6, 2006

(54) SELF-TAILING WINCH CONVERSION

(76) Inventor: David Leitch, P.O. Box 3885, San Rafael, CA (US) 94912

( * ) Notice: Subject to any disclaimer, the term of this patent is extended or adjusted under 35 U.S.C. 154(b) by 61 days.

(21) Appl. No.: 10/813,500

(22) Filed: Mar. 29, 2004

Related U.S. Application Data

(60) Provisional application No. 60/458,294, filed on Mar. 28, 2003.

(51) Int. Cl.
*B66D 1/30* (2006.01)

(52) U.S. Cl. ..... 254/371; 254/383

(58) Field of Classification Search ..... 254/342, 254/344, 371, 373, 374, 383
See application file for complete search history.

(56) References Cited

U.S. PATENT DOCUMENTS 4,453,701 A * 6/1984 Huggett ..... 254/371
4,463,932 A * 8/1984 Shuker ..... 254/266
4,662,609 A * 5/1987 Swenson ..... 254/371
4,815,710 A * 3/1989 Bonassi ..... 254/371
5,897,105 A * 4/1999 Huggett et al. ..... 254/344
6,019,353 A * 2/2000 Atfield ..... 254/278
6,047,955 A * 4/2000 Cavanagh ..... 254/371
6,070,858 A * 6/2000 Hase et al. ..... 254/371
6,250,607 B1 * 6/2001 Strom ..... 254/362

OTHER PUBLICATIONS

Ad from *Latitude 38* magazine, "The Wincher", Aug. 2004, p. 206.

* cited by examiner

*Primary Examiner*—Emmanuel M Marcelo
(74) *Attorney, Agent, or Firm*—Thomas M. Freiburger

(57) ABSTRACT

A self tailing conversion is provided for a standard winch or capstan, particularly a sailboat winch. In one embodiment a self tailer or rope jaw device is secured to the top of the winch drum, and a feeder arm is attached to the stationary center stem of the existing winch. Upward extensions are provided for the stationary center stem and for the driving shaft of the standard winch. Different methods of attachment of the self tailer are described. In a second embodiment a self tailer device is secured below the drum crown of the standard winch, assembled from sections or halves, and a feeder arm is secured to the stationary center stem.

8 Claims, 9 Drawing Sheets

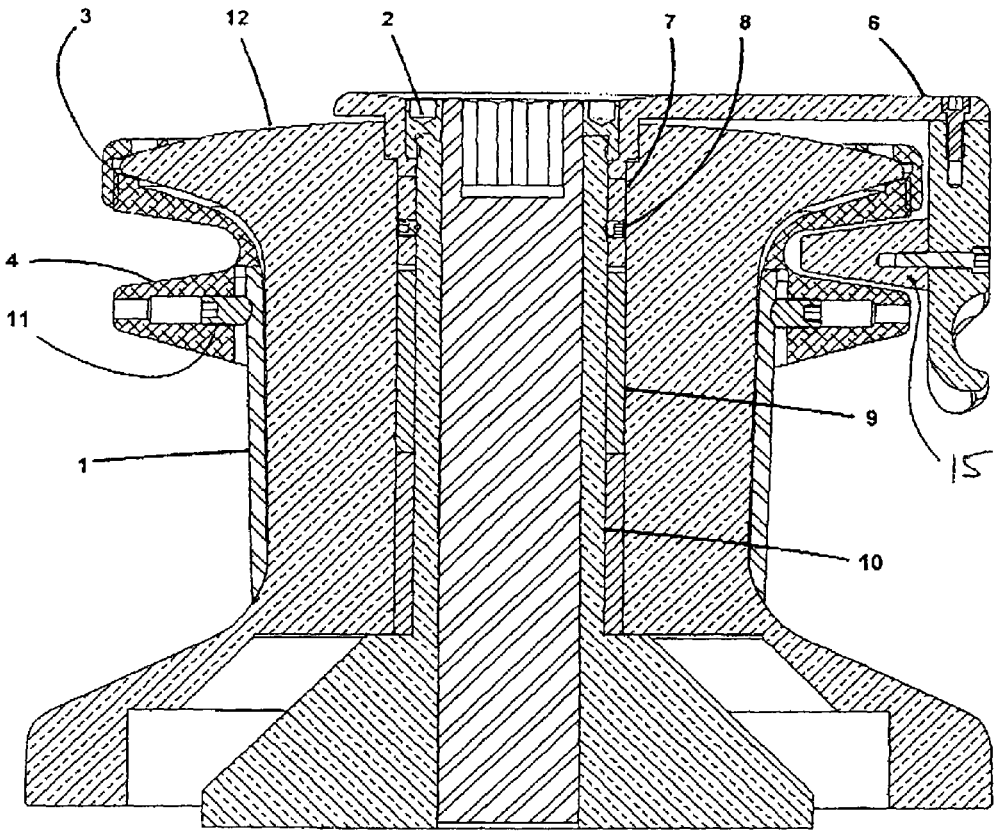
3
12
2
7
8
6
4
11
9
1
15
10

SELF-TAILING WINCH CONVERSION

This application claims the benefit of Provisional Application No. 60/458,294, filed Mar. 28, 2003.

BACKGROUND AND SUMMARY OF THE INVENTION

This invention relates to a winch conversion for a standard winch to provide self-tailing capabilities. Self-tailing refers to the ability to automatically pull and pay out rope as the winch is either manually or mechanically operated. Standard winch refers to a non-self-tailing winch.

Sailboat winches are expensive, and a sailor is hesitant to replace a standard winch with a self-tailing winch because of the cost and the non-use of a costly asset.

Previous modifications of standard sailboat winches to add self-tailing capabilities have been limited to drastic re-manufacturing of the winch, involving complete or nearly complete replacement of the winch drum. Obviously this is very costly, approaching the cost of a self-tailing winch.

In accordance with the invention described herein, a standard sailboat winch or capstan is converted to a self-tailing winch without modification of the drum, or with only very minor modification. A rope crown or rope jaw is attached to an upper part of the drum of the standard winch so as to rotate along with the drum and to prevent relative rotation on the drum. The rope jaw has an annular rope-receiving groove positioned generally concentrically with the winch. A feeder arm is secured to the stationary center stem or spindle of the standard winch, providing a line guide adjacent to and outwardly from the winch drum in a stationary position, and also preferably providing a rope stripper. The line guide feeds a rope out of a coil on the rope drum, over the feeder arm and into the rope-receiving groove of the rope jaw.

In a preferred embodiment, the rope jaw is attached to the top of the winch drum at the upper crown of the drum. It can be secured by a screw threaded engagement; a bottom part of the rope jaw device has a female thread extending down over the upper crown of the winch drum, and engaging with a male threaded ring which is assembled in several sections at the lower side of the upper rope drum crown. The stationary center stem or spindle of the winch is essentially extended upwardly by a fitting that engages with the top of the center stem and provides a stationary top end into which the feeder arm is stationarily secured.

In this top mounting version, the existing spanner nut and winch drum are temporarily removed and an extension is then threaded onto the existing winch shaft. The extension is then secured with multiple internal set-screws so as to lock the extension in a fixed position upon which the self tailing adapter or pulley and line lifter/stripper arm can be installed. The extension consists of a smooth bearing portion with an additional indexing portion that aligns with that of the line lifter/stripper arm so that the line lifter/stripper arm remains in a stationary position while allowing the adapter to rotate while affixed to the winch drum. After installation, the original spanner nut is replaced securing the drum and self tailing assembly.

In another embodiment, the rope jaw is secured underneath the top crown of the standard drum, the lower jaw of the rope jaw being assembled from sections.

It is thus among the objects of the invention to provide an economical and easily implemented self-tailing winch conversion for a standard sailboat winch or capstan. These and other objects, advantages and features of the invention will be apparent from the following description of a preferred embodiment, considered along with the drawings.

DESCRIPTION OF THE DRAWINGS

FIG. 3A is a sectional view in elevation showing the assembled winch conversion of the same embodiment, but with minor changes.

DESCRIPTION OF PREFERRED EMBODIMENTS

An embodiment of a self-tailing winch conversion is shown in FIGS. 1–5.

The rope is held captive by two preferably semi-frictional gripping surfaces 4, called herein a rope crown or line jaw or rope jaw, that rotate with the drum as it turns.

The self tailer or rope crown 4 comprises two halves or pieces that interlock together such as by a dovetail, jig saw joint or other connection 5 when assembled together around the winch drum. More pieces could be used if desired. This allows the self tailer to be installed without altering or replacing the existing drum.

In a preferred embodiment, tapered shims 1 are inserted into vertically oriented slots which have been machined into the inside surfaces of the rope crown or self tailer and which protrude downwardly to achieve several important objectives, as follows:

1. Compensates for minor variations in drum diameters, while centering the rope crown on the winch drum.
2. Provides a friction surface for the rope on the existing drum.
3. Increases the effective diameter of the drum so that the diameter of the drum gathering the rope coils is generally equal to that of the jaws of the rope crown.

Figure 3:
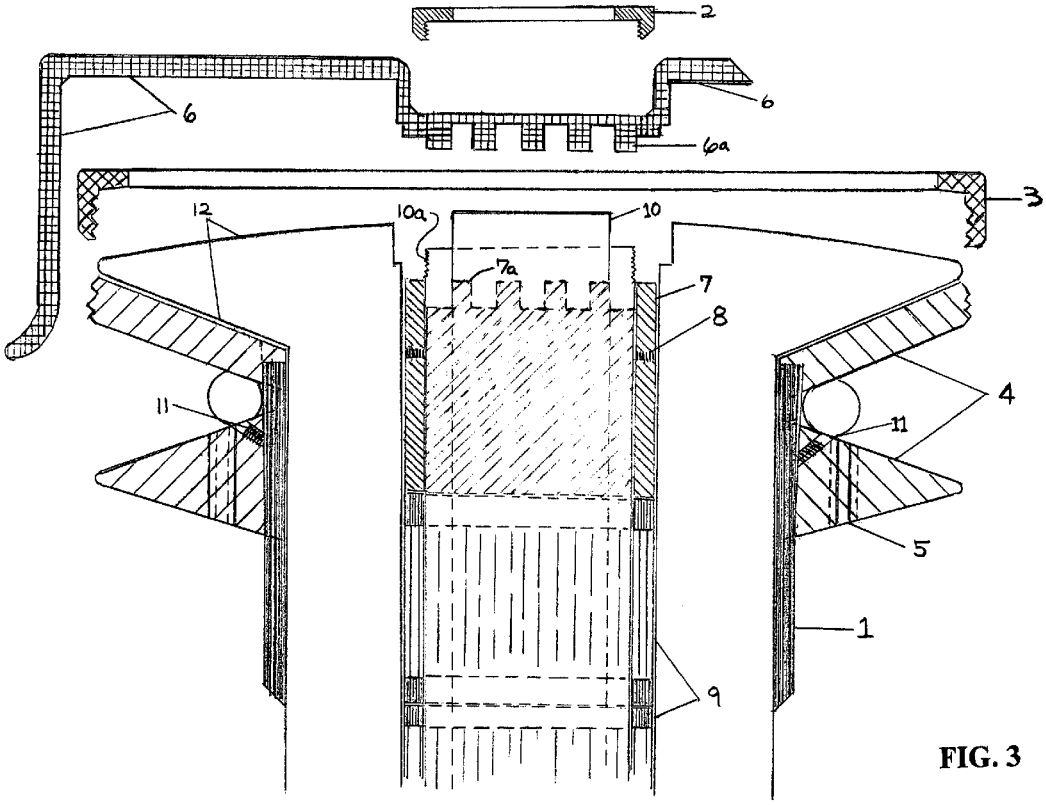
FIG. 3 is an elevation view, partially in cross section and partially exploded, showing an upper portion of the winch assembly of FIG. 1.
Figure 4:
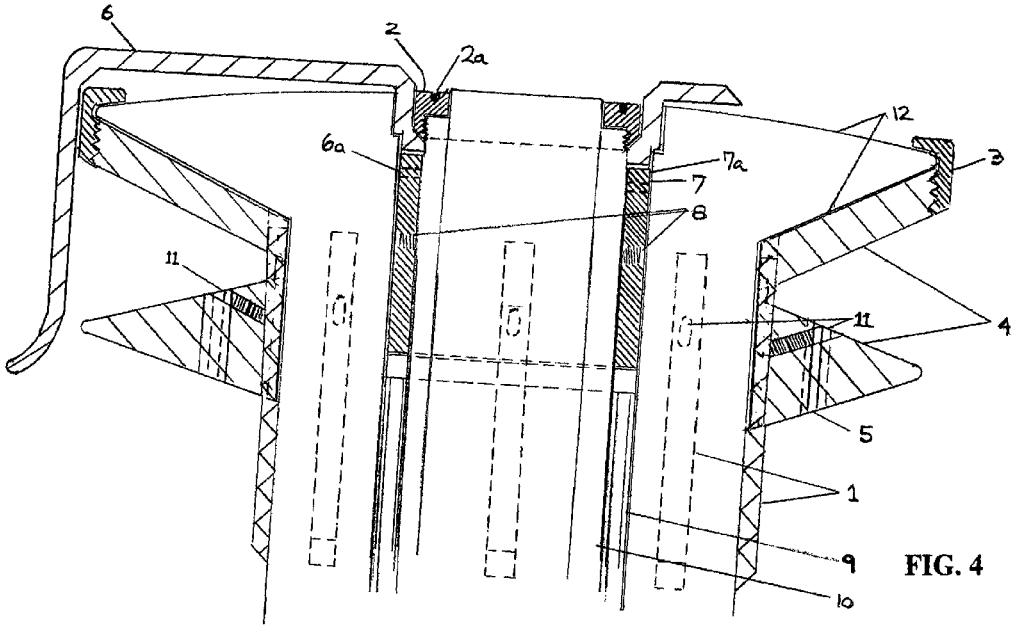
FIG. 4 is another elevation view similar to FIG. 3, partially in cross-section, showing the components all assembled.
Figure 5:
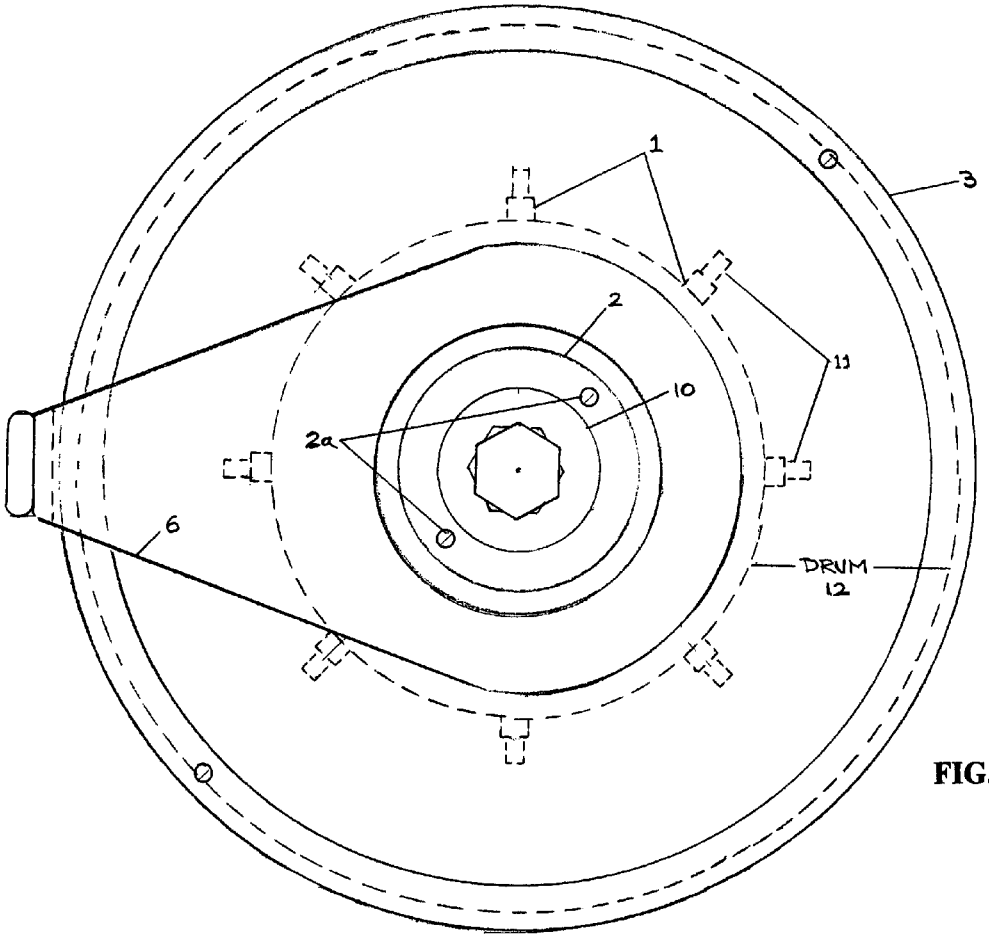
FIG. 5 is a top view of the assembled converted winch.

Although the drawing, particularly the exploded view of FIG. 3, shows the shims 1 with a strong taper, this is exaggerated. The actual taper is at a low enough angle that there is insufficient differential diameter between the drum just below the rope crown and the rope crown itself, for stresses to build up tending to pull and bend the feeder arm or line lifter 6. See FIGS. 4 and 5 for the assembled self-tailing winch. No taper is required if the shims terminate at the radius of the drum.

The shims 1 are tapered such that they will drop down into optimum position to absorb any loose fitting tolerance between the inside diameter of the self tailer/rope crown assembly and the outside diameter of the drum. Additionally, set screws 11 are engaged to prevent the rope crown adapter from rotating on the drum and the shims from sliding up in their respective notches. Variations in the existing drum diameter are generally in the range of thousandths of an inch, up to a maximum of about ⅛ inch, within a given winch size.

The winch conversion of the invention can be made without shims, if desired. If a winch has a drum diameter small for the rope crown conversion, e.g. about ⅛ inch below diameter as noted above, the drum diameter can be increased prior to securing the rope crown assembly, using an appropriate form of tape or wrap. Similarly, the drum diameter below the new rope crown/self tailer can be built up using a tape or wrap, to the extent that the below-rope crown diameter is generally equal to the effective diameter for the rope in the rope crown.

Figure 1:
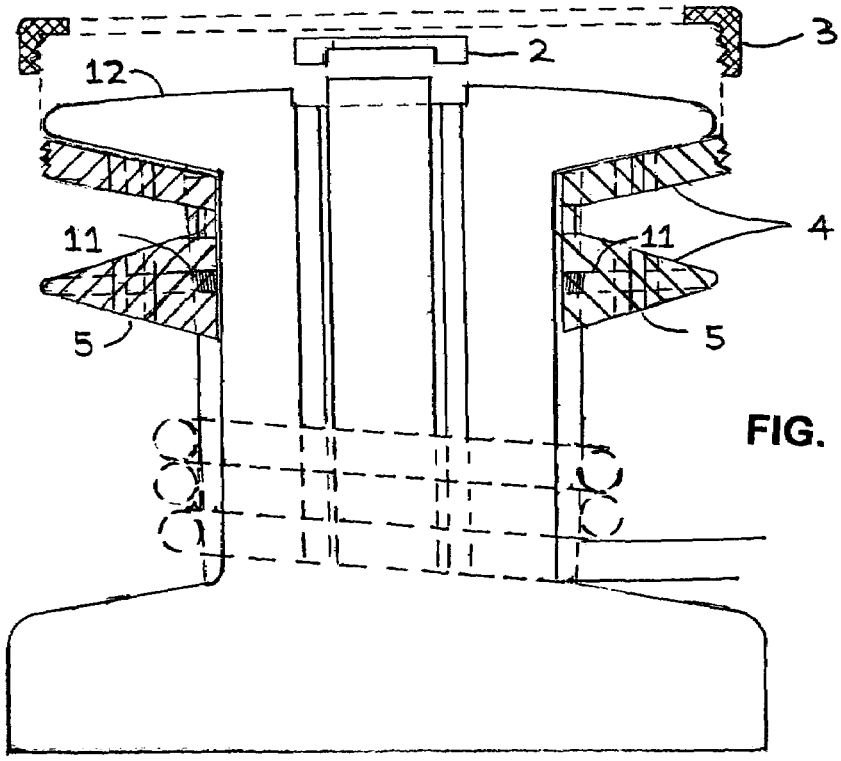
FIG. 1 is an elevation view of a self-tailing winch conversion according to a first embodiment.

The two halves or pieces of the self tailer assembly (divided along a line 5*a* best seen in FIG. 2) are positioned around the existing non-self-tailing winch drum, with the shims 1 held in place, and the two pieces or halves are assembled together by shifting one of the halves vertically relative to the other, in the event the illustrated dove tail connection is used. When the rope crown is thus assembled on the winch, a threaded ring nut 3, comprising an annular ring which covers only an outer peripheral area of the top of the winch, is installed. FIGS. 1 and 3 show that this threaded ring drops down over the crown of the winch and engages with male threads at the outside of the upper part of the rope crown 4. The threaded ring nut 3 is then tightened to hold the rope crown 4 up against the underside of the winch drum's crown 12.

The rope crown device or self tailing adapter 4 is thus firmly held against the underside of the drum crown 12. In addition to or as an alternative to the set screws 11, a rubber or rubber-like material may be positioned between the rope crown and the drum such that once the ring nut 3 is firmly tightened, such relative movement is prevented.

During installation, the winch drum may be removed for the placement of a new bronze bearing 7 with machined crown or gear teeth that allows for the locking of the feeder arm 6 into place. The new bearing 7 replaces the existing top roller bearings 9 such as shown below between the internal surface of the drum and the winch stem 10. Some existing non-self-tailing winches have a spline on the exterior of the stem and some do not. For winches with such a spline, the feeder arm 6 can include a matching spline connection, fitting down over the top of the stem and preventing any rotational movement of the feeder arm (but allowing the feeder arm to be positioned at different angles as desired, by lifting, rotating and replacing the feeder arm). In the case where no such spline is included, the top roller bearing is removed and the new bearing sleeve 7 has a series of notches, as indicated at 7*a* in FIG. 3. The bottom side of the feeder arm component 6 has matching notches 6*a*, and these mate together when the feeder arm is assembled down onto the stem, in the rotational position desired by the user.

The bearing sleeve 7, since it acts as anti-rotational lock for the feeder arm 6, must itself be locked against rotation relative to the winch stem 10. This can be accomplished with set screws 8, threaded into the sleeve at various rotational positions (e.g. four, as shown) and recessed so as not to engage against the drum. This allows the drum to rotate on the bearing, but prevents the bearing from rotating on the stem 10.

Figure 2:
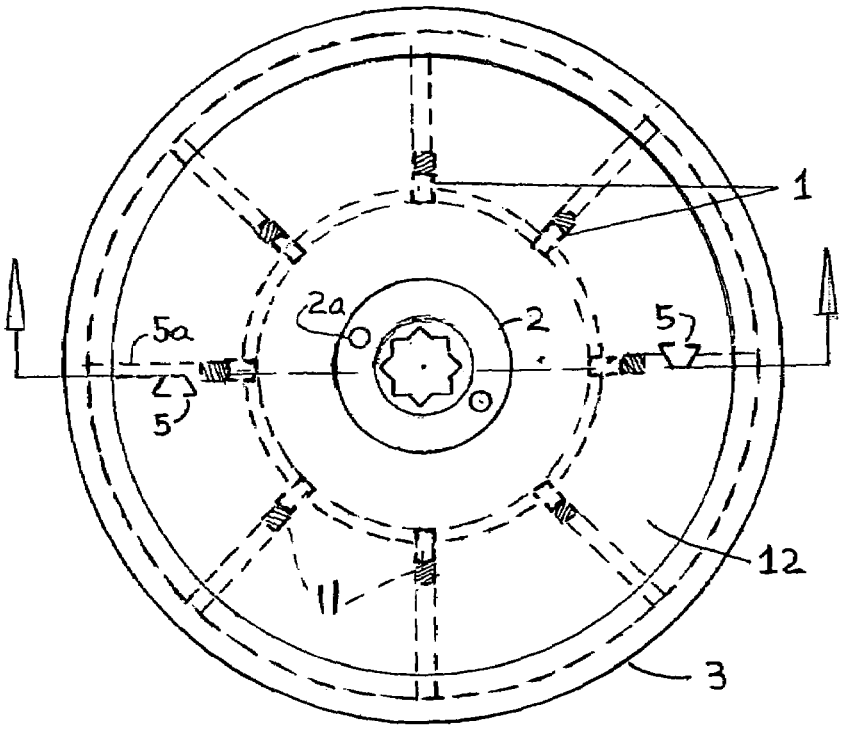
FIG. 2 is a top view of the winch assembly of FIG. 1.

Once the feeder arm is assembled into place, a ring nut or spanner retainer nut 2 is threadedly fitted onto a threaded top 10*a* of the stem. As shown in FIG. 2, this can be tightened with a spanner tool, having two holes 2*a* for engagement by the spanner wrench. This retainer nut 2 thus retains the feeder and drum in place.

FIG. 3A shows the assembled, converted winch in cross section. In this and other views showing the full height of the winch in cross section, the bottom of the winch is shown generically, without the gearing that can take several forms, and without the base that bolts the winch to the boat deck. In this view there are minor changes as compared to FIGS. 1–5. One difference is that retaining set screws 11 are positioned radially rather than at an oblique angle as shown in FIG. 1. Another difference is that the line lifter or feeder arm 6 is shown as having a rope stripper 15 which breaks the rope loose from the wedging gripping surfaces 4 of the rope crown to feed the rope out of the self tailer as the drum is rotated.

Figure 6:
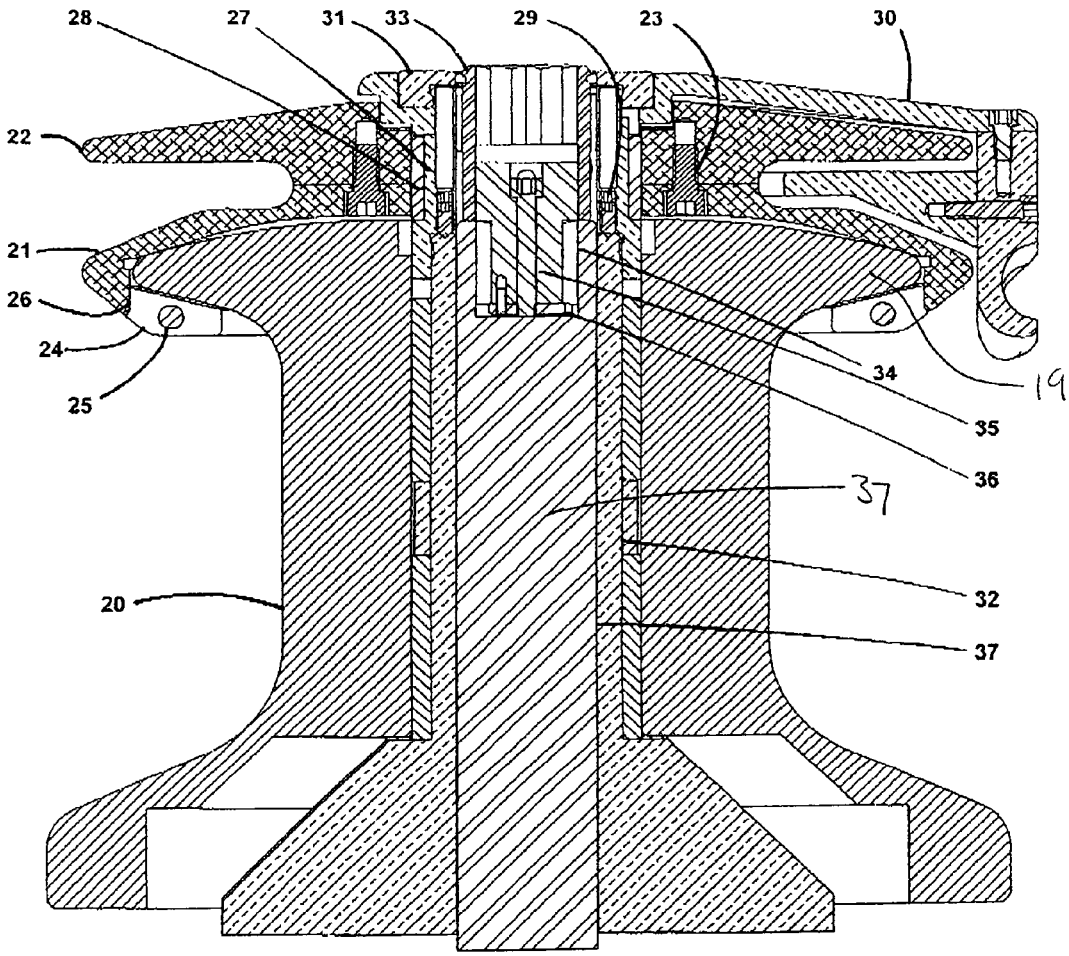
FIG. 6 is an elevation view in section showing a modified embodiment of a converted winch with a self tailer device mounted on top of the winch, and with the lower end of the winch shown generically, without gearing.
Figure 8:
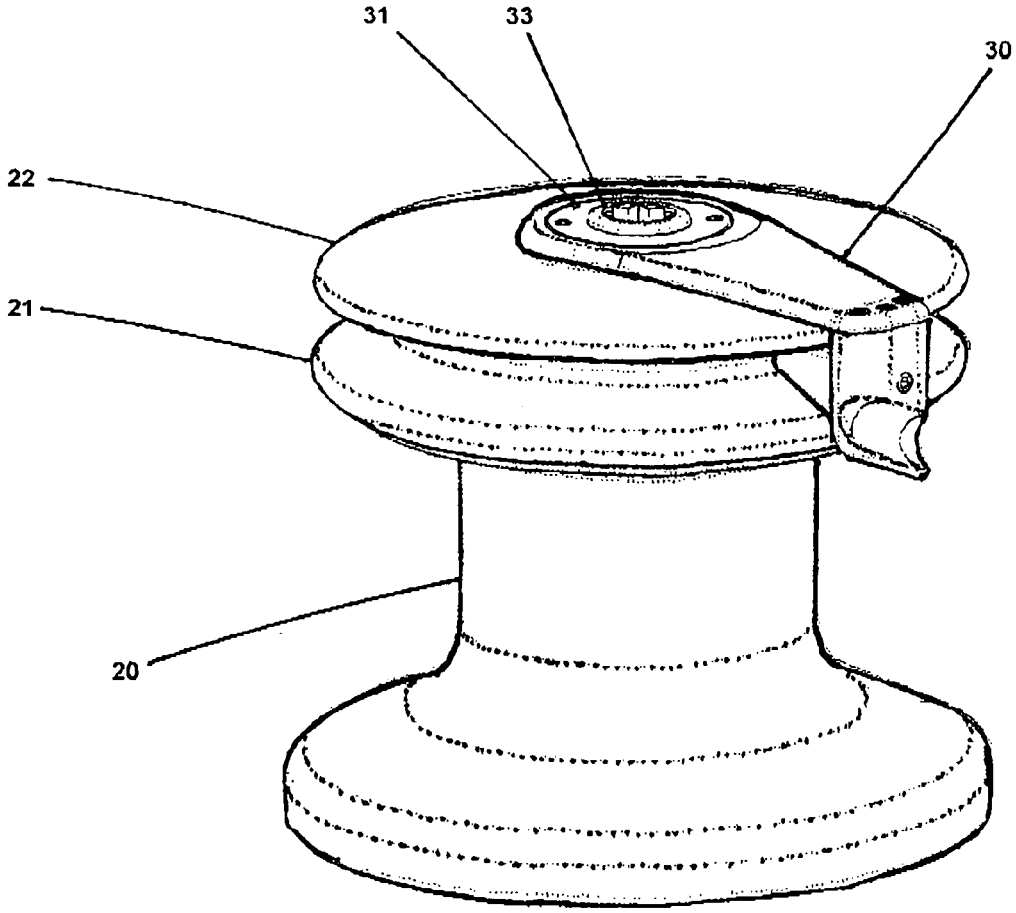
FIG. 8 is a perspective view showing the converted winch of FIG. 6.
Figure 9:
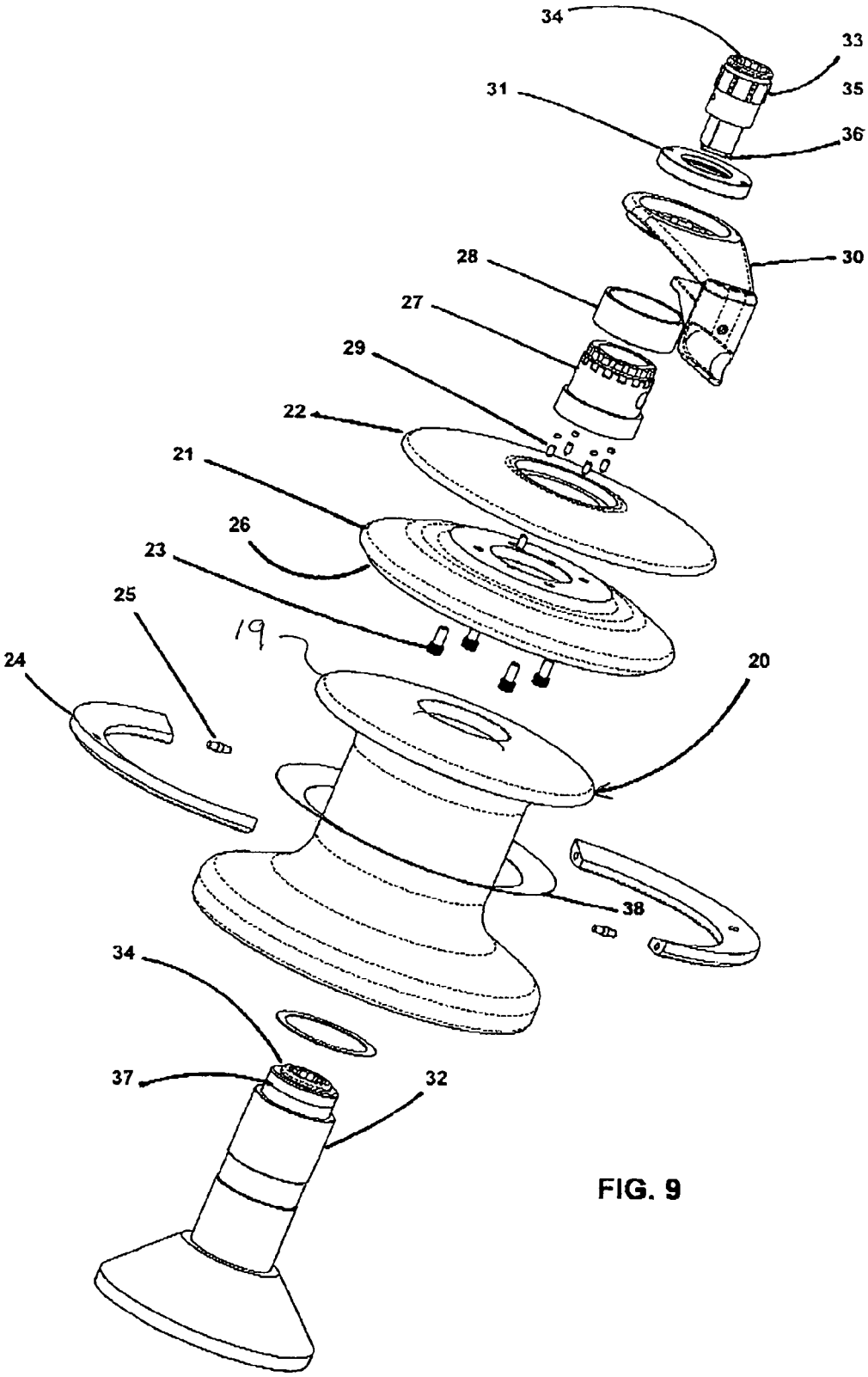
FIG. 9 is an exploded view showing the winch conversion of FIG. 6.

In the second embodiment FIGS. 6, 8 and 9, the self tailer or rope jaw comprises of two halves 21/22, one on top of the other, which are held together such as by locating screws 23 or other connection. The rope jaw could be formed of one piece if desired. In either event, when assembled it comprises one piece that is mounted on top of the drum crown 19, essentially the reverse installation of the first embodiment. This embodiment achieves these additional objectives:

1. provides additional surface area on the existing winch drum 20 for the facilitation of additional wraps of rope;
2. does not require the use of shims as in the first embodiment, as the effective diameter of the adapter is equal to or less than that of the winch drum; and
3. does not require the replacement of the top winch bearing with that of the castle bearing, thus maintaining all of the original bearings.

After positioning the self tailer 21/22 on the drum crown, a two piece-ring 24 with an outer male thread is then placed under the existing drum crown and is momentarily held together by alignment pins 25 so as to form a one piece threaded ring. A friction ring 38 of rubbery or elastomeric material, with a split at one point to enable assembly, preferably is included (see FIG. 9). The ring 24 is then tightened into matching reverse (female) threads 26 located on the under and inside lip of the self tailer thus holding and locking the self tailer to the top of the drum crown. The friction ring 38 between the ring 24 and the underside of the drum crown 19 prevents slippage. The reverse thread allows for the self tailer to self tighten as rope pressure is exerted. This embodiment also allows for the self tailer to be installed without altering or replacing the existing winch drum.

During installation, the winch drum is removed so as to install a spindle extension adapter 27. The spindle extension 27 is fastened by threading or other means to the existing winch spindle/drum base 32 and is further held in place by same screws 29 or other means so as to lock the extension in a fixed position. The upper portion of the spindle extension 27 is machined to include grooves and/or notches for mating and locking with a line lifter/stripper arm 30 in a desired fixed position. Additional machining at the extreme top of the spindle extension allows for a drum retaining spanner nut 31 or other retaining device to be placed. A bearing 28 is placed on the spindle extension 27 to allow for free rotation of the self tailer (rope crown) 21/22 and winch drum 20, relative to the fixed spindle/drum base 32.

The winch drum 20 and attached self tailer 21/22 are then placed over the stationary, hollow winch spindle 32 and spindle extension 27 onto the drum's original location. The line lifter/stripper arm 30 is then installed over the spindle extension 27 and positioned to mate with the spindle in a stationary and fixed position. The matching notches on the spindle extension 27 and the line lifter/stripper arm 30 allow for its various positioning with respect to angle around the drum. The spanner nut or retaining device 31 is then installed.

A locking drive shaft extension 33, designed to receive a standard winch handle, is inserted into the existing winch handle receiver 34, of the winch drive shaft 37. Once inserted, tightening of a screw 35 rotates a keeper 36 that locks the extension into place. The extension is designed to receive a standard winch handle without being dislocated during normal use.

Figure 7:
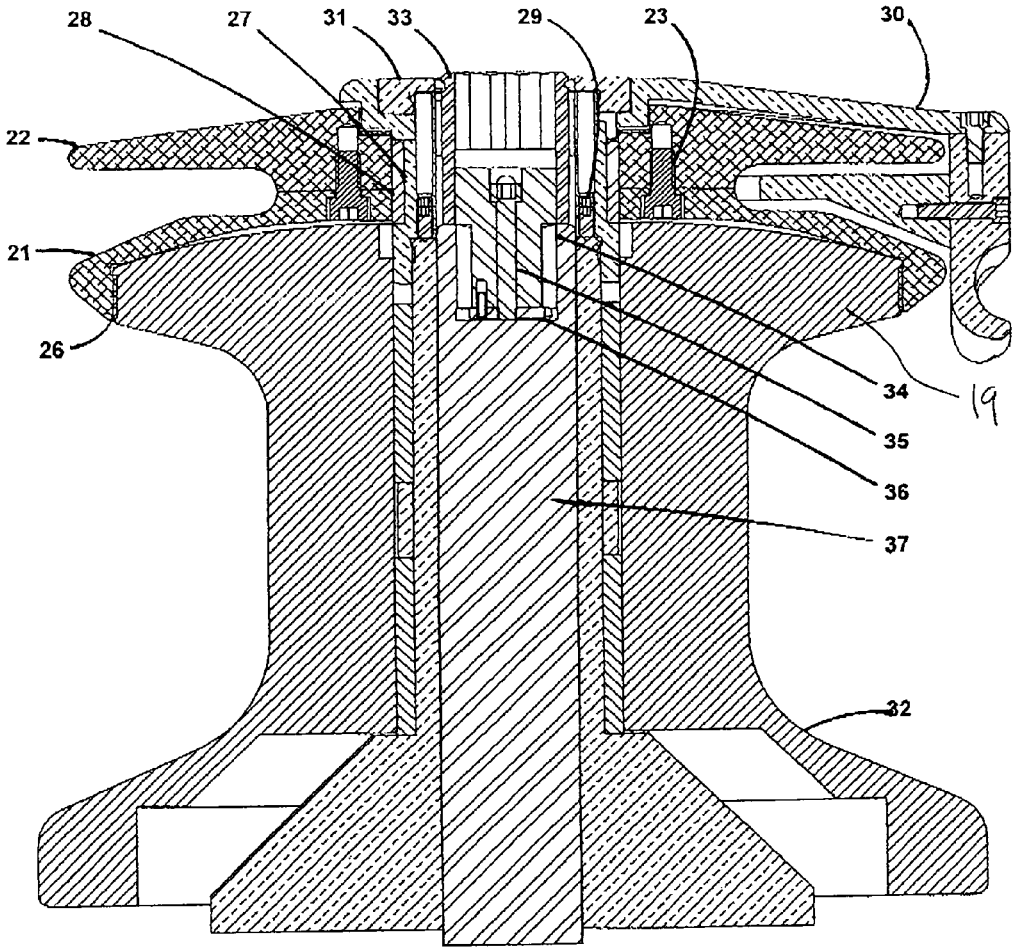
FIG. 7 is a view similar to FIG. 6, but with a modification in the manner of attachment of the self tailing device.

A third embodiment of FIG. 7 comprises the parts listed in the second embodiment but differs in the following respects:

1. The self tailer may be of smaller diameter, threaded directly to a modified winch drum whose drum crown has been reduced in diameter and threaded.
2. This embodiment does not require the use of the two piece retaining ring 24, or alignment pins 25.
3. An objective of this embodiment is that it has a narrower profile and makes paying out of rope more efficient.

Other means can be used to secure the self tailer or rope crown to an existing standard winch drum. For example, the rope crown can be made of one piece (or two, if desired) and secured by drilling and tapping holes in the top of the existing winch drum and then attaching the rope crown with through bolts (machine screws) passing down through the rope crown structure and threaded into the tapped holes. Strong adhesives could be used instead of bolts, or other fasteners could be used, all within the skill of the mechanic. Bolting direct threading and other such alternative means of attachment can also be applied to the first embodiment described above.

Although there are many designs for self-tailing winches, none known to the applicant involves modifying an existing drum; all previous self-tailing modifications have required entire drum replacement.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A method for converting a standard non-self-tailing sailboat winch or capstan having a rope drum rotatable on a stationary center stem, to provide self-tailing capability on the winch or capstan, comprising:

attaching a rope jaw to an upper part of the rope drum of the standard winch to rotate along with the rope drum and to prevent relative rotation on the rope drum, the rope jaw having an annular rope-receiving groove positioned generally concentrically with the winch, and securing a feeder arm to the stationary center stem of the standard winch, the feeder arm having a line guide to be positioned stationary relative to the rope drum and outwardly from the rope drum to feed a rope out of a coil on the rope drum, over the line guide of the feeder arm and into the rope-receiving groove of the rope jaw.

2. The method of claim 1, wherein the rope jaw is attached to the top of the winch rope drum.

3. The method of claim 1, wherein the rope jaw is attached onto the winch rope drum just below a drum crown of the rope drum.

4. A conversion for a standard non-self-tailing sailboat winch or capstan having a rope drum rotatable on a stationary center stem, to provide self-tailing capability on the winch or capstan, comprising:

a rope crown or rope jaw with means for attachment to an upper part of the rope drum of the standard winch to rotate along with the rope drum and to prevent relative rotation on the rope drum, the rope jaw having an annular rope-receiving groove positioned generally concentrically with the winch, the means for attachment of the rope jaw comprising means for attaching the rope jaw onto the winch rope drum just below a drum crown of the rope drum, and a feeder arm with means for securing the feeder arm to the stationary center stem of the standard winch, the feeder arm having a line guide to be positioned stationary relative to the rope drum and outwardly from the rope drum to feed a rope out of a coil on the rope drum, over the line guide of the feeder arm and into the rope-receiving groove of the rope jaw.

5. A conversion for a standard non-self-tailing sailboat winch or capstan having a rope drum rotatable on a stationary center stem, to provide self-tailing capability on the winch or capstan, comprising:

a rope crown or rope jaw with means for attachment to the top of the rope drum of the standard winch to rotate along with the rope drum and to prevent relative rotation on the rope drum, the rope jaw having an annular rope-receiving groove positioned generally concentrically with the winch, the means for attaching the rope jaw to the top of the winch rope drum comprising an annular flange depending downwardly from a bottom side of the rope jaw over the outer edge of a drum crown of the standard winch, and a two-piece ring which is assembled under the drum crown and having a means for attachment to the depending flange to firmly secure the rope jaw in position on top of the drum crown, and a feeder arm with means for securing the feeder arm to the stationary center stem of the standard winch, the feeder arm having a line guide to be positioned stationary relative to the rope drum and outwardly from the rope drum to feed a rope out of a coil on the rope drum, over the line guide of the feeder arm and into the rope-receiving groove of the rope jaw.

6. The winch conversion of claim 5, further including a friction ring positioned between the two-piece ring and the lower surface of the drum crown to prevent slippage.

7. The winch conversion of claim 5, wherein the external and internal threads are reverse threads.

8. The winch conversion of claim 5, wherein the means for attachment to the depending flange comprises an internal thread on the depending flange, and external threads on the two-piece ring positioned to engage with the internal threads of the depending flange, so that the rope jaw is screwed onto the two-piece ring.

* * * * *